United States Patent [19]

Fee

[11] 4,265,316

[45] May 5, 1981

[54] FIRE EXTINGUISHING SYSTEM HAVING A LINKAGE OPERATED VALVE

[75] Inventor: David M. Fee, Groveland, Ill.

[73] Assignee: Caterpillar Tractor Co., Peoria, Ill.

[21] Appl. No.: 140,386

[22] Filed: Oct. 15, 1979

[22] PCT Filed: Oct. 15, 1979

[86] PCT No.: PCT/US79/00845

§ 371 Date: Oct. 15, 1979

§ 102(e) Date: Oct. 15, 1979

[51] Int. Cl.[3] ..... A62C 35/02; A62C 35/12

[52] U.S. Cl. ..... 169/19; 169/26; 169/60; 169/62; 239/578; 251/62; 251/229

[58] Field of Search ..... 169/19–21, 169/26, 60–62, 89; 222/314; 251/62, 63.4, 229; 239/578

[56] References Cited

U.S. PATENT DOCUMENTS

| | | | |
|---|---|---|---|
| 3,276,699 | 10/1966 | Graveley | 239/578 X |
| 3,316,974 | 5/1967 | Cholin | 169/26 |
| 3,768,567 | 10/1973 | Weise | 169/26 |
| 4,043,353 | 8/1977 | Shirey | 251/229 X |

*Primary Examiner*—Robert J. Spar
*Assistant Examiner*—Fred A. Silverberg
*Attorney, Agent, or Firm*—Wegner, Stellman, McCord, Wiles & Wood

[57] ABSTRACT

A fire extinguishing system including a vessel (10) for receipt of a fire extinguishing material and having an outlet (12) closed by a flow control mechanism (14). A linkage (20,30) provides for suitable operation or actuation of the flow control mechanism (14). A double rod ended cylinder 36 is employed for operating the linkage in response to a remotely generated pressure signal or in response to manual actuation by a manual actuator (66) coupled to one of the rod ends (38).

5 Claims, 3 Drawing Figures

REMOTE ACTUATOR

FIRE EXTINGUISHING SYSTEM HAVING A LINKAGE OPERATED VALVE

DESCRIPTION

TECHNICAL FIELD

This invention relates to a fire extinguishing system of the type that may be manually activated by manual application of force or remotely activated by a remotely generated signal such as a pressure signal.

BACKGROUND ART

The most pertinent prior art known to the applicant includes a commercially available fire extinguishing system manufactured by Chemetron Fire Systems Division of Chemetron Corporation and which is utilized by the assignee of the instant application in certain of its products as Part No. 5G1590.

There are many environments of widely varying character requiring fire extinguishing or suppression systems wherein provision is made for alternately activating the system manually as, when a person in the environment observes the existence of a fire or automatically, as, for example, when a sensor in the area protected by the system detects some condition in that area that is associated with a fire. Systems of this sort are employed in, for example, restaurants, industrial applications where a fire possibility exists, vehicles, etc. Typically there will be provided a vessel for containing the fire extinguishing material which is provided, at its outlet, with a flow control device such as a valve, a diaphragm piercing device, or both for normally closing the vessel to maintain the fire extinguishing material therein but operable to release the extinguishing material when needed. Various means have been employed to direct fire extinguishing material exiting the outlet to the area to be protected.

Sensors are employed in the area to be protected to control actuation of the flow control apparatus and in the general vicinity of the area to be protected, there is typically employed a manual actuator for the flow control which can have a manual force applied thereto by a person in the vicinity of the area to be protected upon the observation of a fire therein.

In the case of the above identified prior art, the system is employed in a vehicle, and specifically, in the engine compartment therein. The flow control of the system is activated in response to movement of a linkage which in turn is operated by a pneumatic cylinder in response to a pneumatic pressure signal generated by a sensing system. In addition, in the prior art system, there is provided a cable extending from the linkage which may be pulled upon the observance of a fire to activate the system.

While these systems have proved quite satisfactory, there occasionally arises binding or slippage in the cable system which may interfere with ease of activation. In some cases, improper adjustment of the cable can also impede proper activation.

DISCLOSURE OF THE INVENTION

The present invention is directed to overcoming one or more of the above problems.

According to the present invention, there is provided a fire extinguishing system including a vessel for receipt of a fire extinguishing material and having an outlet. A flow control mechanism is provided for normally closing the outlet to maintain fire extinguishing material in the vessel until needed. A linkage is utilized for actuating the flow control mechanism to open the outlet and a fluid cylinder is connected to the linkage for operating the same in response to a remotely generated fluid pressure signal. A manual actuator is connected to the linkage for operating the same in response to manual activation by manual, mechanical movement. The invention is characterized by the cylinder being a double rod ended cylinder having one rod end connected to the linkage. The cylinder has an inlet for receipt of pressure fluid to drive the one rod end in one direction to operate the linkage. The system of the invention is further characterized by the manual actuator being a movable handle coupled to the other end of the cylinder and manually operable to drive the one rod end in the one direction to operate the linkage.

The system eliminates cable binding and adjustment problems, and, when used in a vehicle is less affected by vibration. A system made according to the present invention may be made of smaller size than a comparably rated system made according to the prior art and with less expense.

BEST MODE FOR CARRYING OUT THE INVENTION

Figures 1, 2:
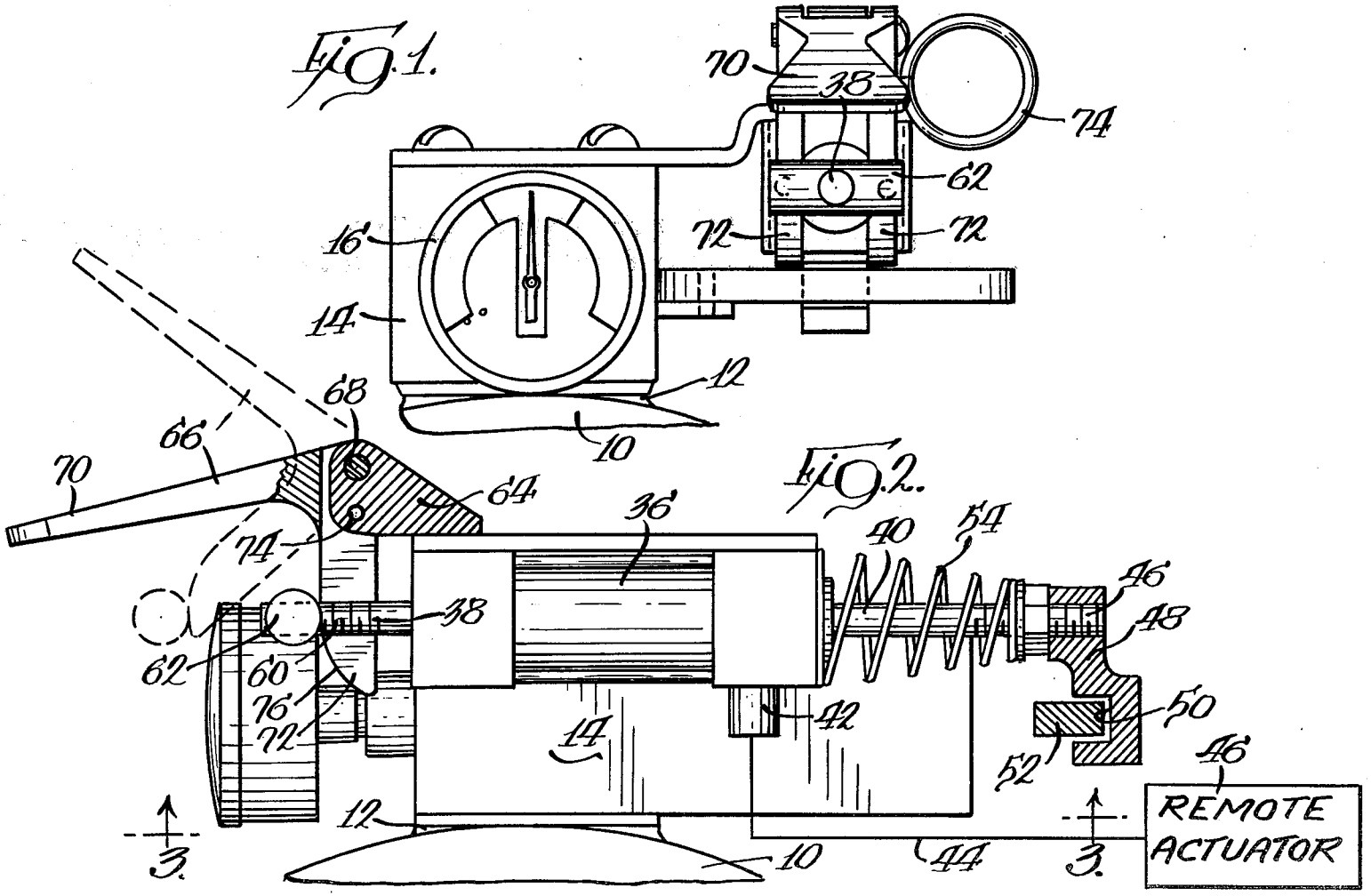
FIG. 1 is a front elevation of a fire extinguishing system made according to the invention.
FIG. 2 is a sectional view taken approximately along the line 2—2 in FIG. 3.

An exemplary embodiment of a fire extinguishing system made according to the invention is illustrated in the drawings and is seen to include a pressure vessel 10 having an upper, outlet end 12. The outlet end 12 is closed by a flow control device in the form of a conventional valve 14 which is provided with a pressure gauge 16 in the usual fashion to thereby allow a determination of whether the vessel 10 is overcharged, undercharged or properly charged.

Figure 3:
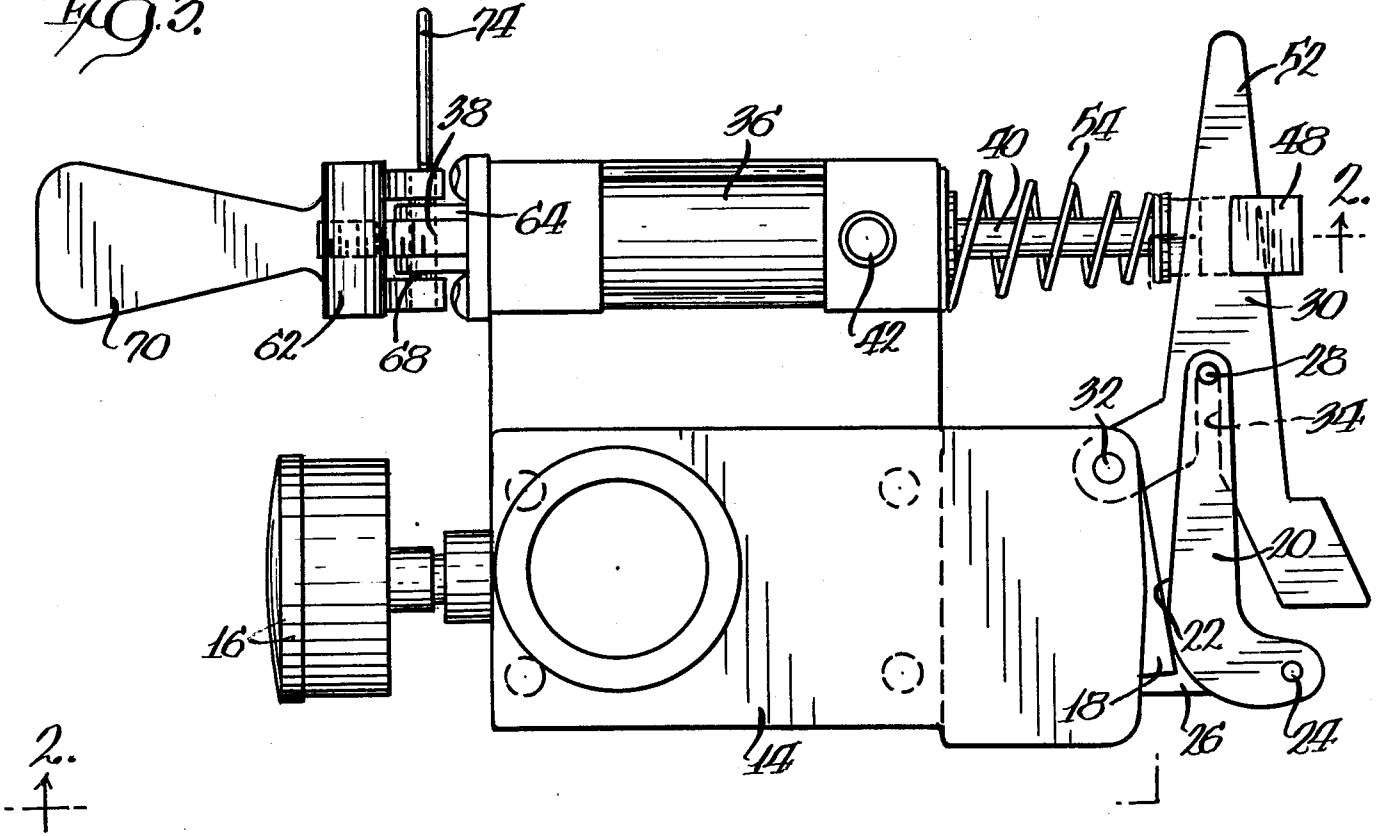
FIG. 3 is a sectional view taken approximately along the line 3—3 in FIG. 2.

As seen in FIG. 3, the valve 14 includes an actuator 18 which, when held in the position illustrated, will cause the valve 14 to be closed to contain the fire extinguishing material within the vessel 10. When the actuator 18 is permitted to pivot in a counterclockwise direction as viewed in FIG. 3, the valve 14 will open to release fire extinguishing material to be directed to the area to be protected by means (not shown).

There is provided a linkage for actuating the valve 14 including a lever 20 having a blocking surface 22 bearing against the actuator 18 to normally maintain the same in a position corresponding to a closed valve condition. The lever 20 is pivotally mounted at 24 to a bracket 26 extending from the valve 14 and at its end opposite the pivot 24, mounts a pin 28.

The linkage includes a second lever 30 which is pivotally mounted to the valve 14 by a pivot pin 32 and which includes an elongated slot 34 receiving the pin 28. When the lever 30 is in the position illustrated in FIG. 3, pivotal movement of the lever 20 is prevented by engagement of the pin 28 within the slot 34. However, when the lever 30 is pivoted in a counterclockwise direction as viewed in FIG. 3, at some point in such movement, the slot 34 will open to release the pin 28 and allow the lever 20 to pivot in a clockwise direction thereby releasing the actuator 18 to cause the valve 14 to open.

Control of the position of the lever 30 is maintained by actuator components including a pneumatic cylinder 36. The pneumatic cylinder 36 is a double rod ended cylinder; that is, it includes a single interior piston (not shown) connected to a piston rod having ends extending from both ends of the cylinder 36 as illustrated at 38 and 40. As seen in FIG. 2, the end of the cylinder 36 adjacent the rod end 40 is provided with an inlet port 42 which may receive a pressure signal on a line 44 from a suitable remote actuator or sensor 46 disposed in the area to be protected and in the cab of the vehicle. When such a signal is received, the rod ends 38 and 40 move to the left as viewed in FIGS. 2 and 3.

The rod end 40 is threaded as at 46 and mounts a downwardly extending yoke 48 provided with a horizontally opening groove 50. An end 52 of the lever 30 is received in the groove 50 and as can be appreciated from FIGS. 2 and 3, upon actuation of the cylinder 36 by a pressure signal, the lever 30 will be rotated in a counterclockwise direction as viewed in FIG. 3 to actuate the system.

A coil spring 54 is abutted between the right-hand end of the cylinder 36 and the yoke 48 to bias the rod ends 38 and 40 in a direction opposite the direction of movement required for activation.

The rod end 38 is likewise threaded as at 60 to threadably receive a cylindrically shaped cross member 62 in an adjustable fashion during assembly. After assembly and suitable adjustment, the cross member 62 will be affixed against movement as, for example, by staking or the use of a suitable adhesive.

An upstanding bracket 64 is mounted on the left-hand end of the cylinder 36 and a manual actuator 66 is privoted thereto by means of a pivot pin 68. The manual actuator 66 is in the form of a bell crank having a graspable end 70 to which a manual force may be applied to manually activate the system as will be seen. The other end of the bell crank is bifurcated as at 72 to extend on both sides of the rod end 38 at a location between the cross member 62 and the left end of the cylinder 36. Consequently, by pivoting the manual actuator 66 in a clockwise direction by the application of an upward force to the graspable end 70, the bifurcated end 72 will engage the cross member 62 in a slidable fashion and move the rod ends 38 and 40 to the left as viewed in FIGS. 2 and 3 to activate the system.

Preferably, both the bracket 64 and the upper part of the bifurcated end 72 of the activator 66 are provided with aligned apertures for receipt of a conventional arming pin 74. Finally, the sides of the bifurcated end 72 shown at 76 are preferably slightly rounded so as to prevent any binding between the bifurcated end 72 and the cross member 62 during movement from the position illustrated in FIG. 2 in solid lines to the dotted line position.

INUDSTRIAL APPLICABILITY

A fire extinguishing system made according to the present inventIon eliminates the possibility of binding in manual actuation portions of such systems through the unique use of a double rod ended cylinder such as the cylinder 36 and a coupling of a manual actuator such as the actuator 66 to one end thereof, while providing for activation of a lever or linkage mechanism in the system by the other end of the cylinder 36. An extremely compact structure is provided and one which is economical as well. Because there are no loose parts in the actuating system, such as cables or the like, the system is ideally suited for use in environments where vibration is common as, for example, in connection with vehicles. Because there are no loose parts to vibrate, dependable actuation of the system can be had in all instances.

I claim:

1. A fire extinguishing system including a vessel (10) for receipt of a fire extinguishing material and having an outlet (12), a flow control mechanism (14) normally closing the outlet to maintain fire extinguishing material in the vessel until needed, a linkage (20,30) for actuating the flow control mechanism to open the outlet, a fluid cylinder (36) connected to the linkage for operating the same in response to a remotely generated fluid pressure signal, a manual actuator (66) connected to the linkage for operating the same in response to manual activation by manual, mechanical movement and characterized by the cylinder (36) being a double rod ended (38,40) cylinder having one rod (40) end connected to the linkage, the cylinder having an inlet (42) for recipt of pressure fluid to drive said one rod end in one direction to operate the linkage, and further characterized by the manual actuator being a movable handle (70,72) coupled to the other rod end (38) of said cylinder and manually operable to drive said one rod end in said one direction to operate the linkage.

2. The fire extinguishing system of claim 1 further characterized by a spring (54) biasing said one rod end in a direction opposite said one direction.

3. The fire extinguishing system of claim 1 or 2 further characterized by said handle being a bell crank pivoted (68) on said vessel and having a connecting end (72) engaging said other rod end and a graspable end (70) for receiving a manually applied pivoting force.

4. The fire extinguishing system of claim 3 further characterized by a cross member (62) on said other rod end, said bell crank connecting and extending between said cross member and said cylinder and slidably engaging the same.

5. The fire extinguishing system of claim 4 wherein said other rod end (38) is threaded (60) and said cross member is adjustably received thereon and then secured in place.

* * * * *